United States Patent [19]

Landwehrkamp

[11] Patent Number: 4,698,879

[45] Date of Patent: Oct. 13, 1987

[54] DRUM FOR CARDING MACHINES

[75] Inventor: Hans Landwehrkamp, Lenting, Fed. Rep. of Germany

[73] Assignee: Schubert & Salzer, Ingolstadt, Fed. Rep. of Germany

[21] Appl. No.: 904,657

[22] Filed: Sep. 5, 1986

[30] Foreign Application Priority Data

Sep. 6, 1985 [DE] Fed. Rep. of Germany ..... 3531850

[51] Int. Cl.[4] ..... D01G 15/04

[52] U.S. Cl. ..... 19/98; 19/112

[58] Field of Search ..... 19/98, 112

[56] References Cited

U.S. PATENT DOCUMENTS 273,573 3/1883 Maxfield ..... 19/112

273,878 3/1883 Moulton ..... 19/112

451,351 4/1891 Whitaker ..... 19/112 X

FOREIGN PATENT DOCUMENTS 0739311 10/1955 United Kingdom ..... 19/112

*Primary Examiner*—Louis K. Rimrodt

*Attorney, Agent, or Firm*—Julian W. Dority

[57] ABSTRACT

A drum for carding machines, which has a casing made of sheet steel. The two ends of the cases are supported by two hubs which are attached to the drive shaft. The interior of the casing is divided internally into cells by plurality of radial support elements which are connected rigidly to the inside of the casing and to the drive shaft. The support elements may be connected to a central support pipe which connects the two end hubs or the support elements may connect directly with the drive shaft.

4 Claims, 2 Drawing Figures

DRUM FOR CARDING MACHINES

BACKGROUND OF THE INVENTION

The invention concerns a drum for carding machines, the casing of said drum being made of steel sheet, each end of which is supported by a hub attached to the drive shaft.

Drums and rollers used to feed fiber material into textile machines, and to process and transform fiber material in said machines, are made of different materials. There are card drums, for example, and draw-off rollers, clearers and carding work drums that are made of cast iron or steel. Each of these materials has disadvantages. Cast iron drums are very heavy and, aside from a high expenditure of force for repair or maintenance work to be performed on them, they require more driving power. It is a known fact that card drums made of steel are considerably lighter, and that the disadvantages listed above, therefore, apply to a much lesser extent to drums made of steel.

Nevertheless, steel drums have not been practical so far. One of the main reasons for this is the lack of dimensional stability in the static and dynamic states, especially when carding at the high drum speeds used today, and with drums of greater widths. Card drums, consisting of a casing supported at its ends by means of cross spokes on the shaft, have been provided with reinforcing, annular ribs, distributed over the length of the casing. This has resulted in satisfactory dimensional stability with cast iron drums. This design has not, however, proved itself satisfactory with steel drums.

SUMMARY OF THE INVENTION

It is an objective of the invention to create a drum for carding machines, made of a steel sheet casing, and having a high degree of dimensional stability, even at high speeds.

This objective is attained by dividing the drum internally into cells, by means of radial support elements which are connected to the casing of the drum.

In a preferred embodiment of the invention, the hub of the drum comprises of a central pipe which connects the two hubs and the support elements are supported by said pipe. In yet another embodiment, the support elements are supported directly on the drive shaft. Especially good dimensional stability of the drum is achieved if the support elements consist of steel discs welded to the casing of the drum and to the central pipe. Supporting elements supported directly on the drive shaft can be made in the form of cast iron crosses or spokes which are connected to both the drum casing and to the drive shaft.

The cellular construction of the drum has proven to be especially effective when the ratio between the width of the cells or the distance between the support elements and the diameter of the drum is between 1:4 and 1:6. The axial rigidity of the drum is further improved by supporting the steel discs in the axial direction against the central pipe. In order to reduce the weight of the drum, the steel discs are provided with openings. Due to the fact that the drum is attached to the drive shaft by means of tensioning elements, it can be attached without tension to the drive shaft. Preferably, flanges are provided to receive the drum on the steel discs. To prevent the drum from deflecting in the direction of the adjacent operating elements, especially when strong braking force is applied, the drive shaft furthermore supports the drum centrally.

BRIEF DESCRIPTION OF THE DRAWING

Two embodiments of the invention are described in greater detail hereinbelow with reference to the drawings, in which.

DETAILED DESCRIPTION OF THE DRAWINGS

Figure 1:
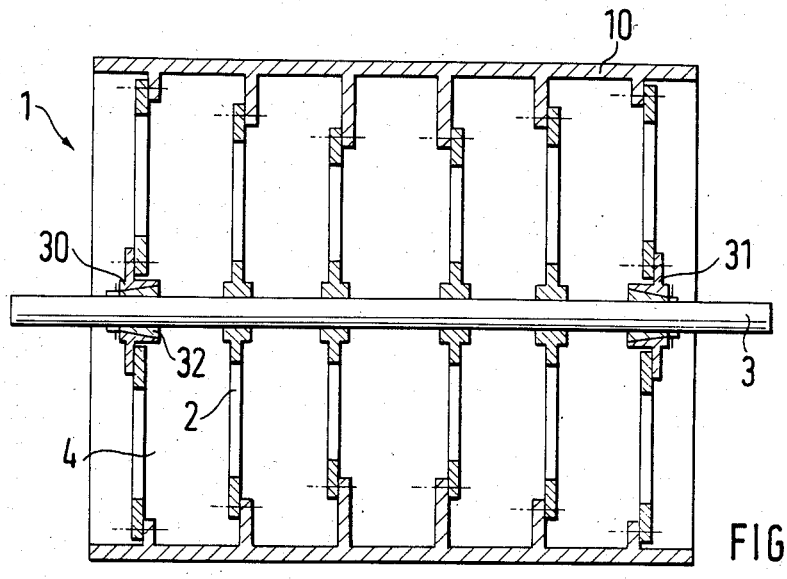
FIG. 1 is a diagrammatic side view, in section, of a drum constructed in accordance with the invention, having a cellular construction with radial support elements supported directly on the drive shaft.

The drum shown in FIG. 1 has a casing 10 made of steel sheet. Radial support elements 2 are installed inside the drum 1 and are connected to the casing 10 of the drum and to a drive shaft 3 on which they are supported. The casing 10 is supported at each of its two ends by hubs 30 and 31, attached to the drive shaft 3. The drum 1 is attached to drive shaft 3 by means of tensioning elements 32.

The support elements 2, installed at equal distances from each other, and which can consist of cast iron crosses or spokes, divides the interior of the drum 1 into cells 4 of equal widths. A ratio from 1:4 to 1:6 of the width of the cells 4 to the diameter of the drum 1 has proven effective for the maintenance of dimensional stability.

Figure 2:
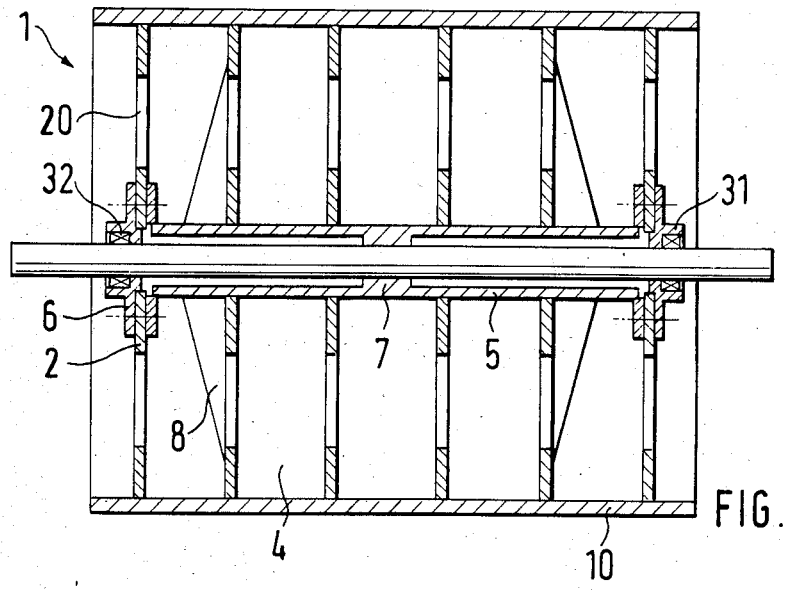
FIG. 2 is a diagrammatic side view, in section, of another embodiment of a drum, constructed in accordance with the invention, having a cellular construction with radial support elements, supported by a central pipe which extends around the drive shaft.

In the embodiment according to FIG. 2, the drum's hub includes a central pipe 5, extending the supporting length of the casing 10 and thus connecting the two hubs 30 and 31 of FIG. 1, to each other. The support elements 2 are made in the form of steel discs in this case and are supported on the central pipe 5. The steel discs, which can be provided with openings 20 to reduce their weight, are welded to the steel shaft casing 10 and to the central pipe 5. However, other types of connection are also possible.

The connection of the steel discs to the casing 10 should, preferably, be established without interruption over the entire circumference of the steel discs. The drum 1 is received by flanges 6, which are attached to the outer steel discs, and is connected, in a torsion-proof manner, to the drive shaft 3 by means of tensioning elements 32. The tensioning elements can, for example, consist of annular springs.

In this embodiment too, the steel discs, constituting the support elements 2, divide the interior of the drum into cells 4 of equal width. The drum 1 is given high dimensional stability by this design, even when high centrifugal forces are involved, approaching that of a solid body and thereby ensuring a correspondingly high degree of rotating precision.

In order to further increase rigidity, especially for extra-wide card machines, and so as to avoid movement of the drum in the direction of the adjacent operating elements when strong braking forces are applied, a support 7 for the drum 1 is provided centrally, inside the central pipe 5. Furthermore, to improve rigidity of the drum 1 in the axial direction, an effective means consists in supporting the steel discs additionally against the central pipe 5. This can be accomplished by means of ribs, struts, etc.

While two embodiments of the invention have been described using specific terms, such description is for illustrative purposes only, and it is to be understood that changes and variations may be made without departing from the spirit or the scope of the following claims.

What is claimed is:

1. A drum for high speed, high performance carding machines, comprising:

(a) a sheet steel cylindrical casing extending the length of said drum;

(b) a drive shaft for said drum, extending concentrically of said casing and for the length of said drum;

(c) a hub attached to said drive shaft at each end of said drum by means of tensioning elements;

(d) a pipe disposed concentrically about said drive shaft, extending from one of said hubs to the other; and (e) a plurality of steel disks disposed within said steel casing, spaced at equal distances from each other, each of which is welded to the internal circumference of said steel casing, the end disks thereof being also welded to said hubs and to said pipe and the other disks being welded to said pipe, the spacing of said disks having a ratio of from 1:4 to 1:6 to the diameter of said drum, whereby said drum is divided into cells to equal width and said drum is dimensionally stable at high rotational speeds.

2. A drum for carding machines as set forth in claim 1, wherein said steel discs are supported in an axial direction against the central pipe.

3. A drum for carding machines as set forth in claim 1, wherein said steel discs are provided with openings.

4. A drum for carding machines as set forth in claim 1, wherein flanges are provided to connect said casing to the steel discs.

* * * * *